United States Patent [19]

Rohner et al.

[11] Patent Number: 4,608,815

[45] Date of Patent: Sep. 2, 1986

[54] COMPRESSED-AIR THREAD SPLICING DEVICE

[75] Inventors: Joachim Rohner; Reinhard Mauries; Heinz Zumfeld, all of Monchen-Gladbach, Fed. Rep. of Germany

[73] Assignee: W. Schlafhorst & Co., Monchen-Gladbach, Fed. Rep. of Germany

[21] Appl. No.: 674,606

[22] Filed: Nov. 26, 1984

[30] Foreign Application Priority Data

Nov. 26, 1983 [DE] Fed. Rep. of Germany ..... 3342858

[51] Int. Cl.[4] ..... D01H 15/00

[52] U.S. Cl. ..... 57/22

[58] Field of Search ..... 57/22, 23, 261, 263, 57/350, 908, 250, 251, 352, 295, 297

[56] References Cited

U.S. PATENT DOCUMENTS 4,344,277 8/1982 Rohner et al. ..... 57/22
4,416,110 11/1983 Mima ..... 57/22
4,445,319 5/1984 Rohner et al. ..... 57/22

FOREIGN PATENT DOCUMENTS 133942 10/1963 France ..... 57/22
2081328 2/1982 United Kingdom ..... 57/22

*Primary Examiner*—Donald Watkins
*Attorney, Agent, or Firm*—Herbert L. Lerner; Laurence A. Greenberg

[57] ABSTRACT

A compressed-air thread splicing device for producing a knotless thread connection by splicing, the device having a splicing channel for receiving therein threads to be spliced to one another, the splicing channel being formed with at least one compressed-air injection opening and affording at least one of a plurality of operations to be performed on the fibers of the threads consisting of tangling, hooking, whirling and entwining the thread fibers mutually includes a first device for forming a thread guide contour edge at one end of the splicing channel, and a second device for forming a thread guide contour edge at the other end of the splicing channel, the thread guide contour edges partly covering a respective outlet and inlet of the splicing channel, and a controllable device for holding at least end fibers of ends of the threads in friction contact with at least one of the thread guiding contour edges during the splicing operation.

12 Claims, 5 Drawing Figures

FIG. 4
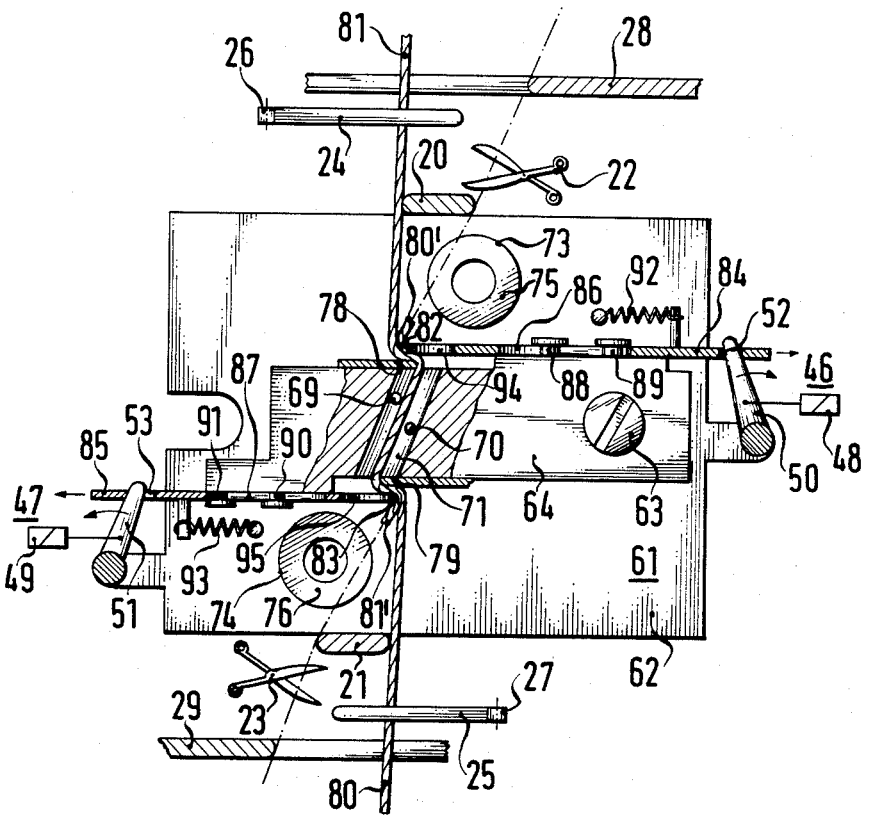
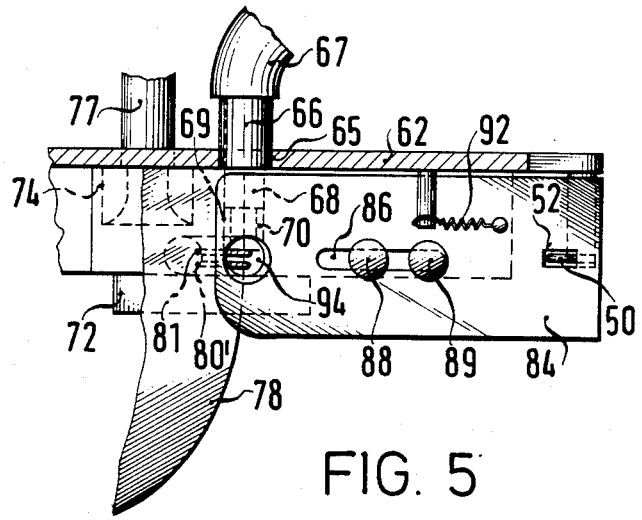
FIG. 5

COMPRESSED-AIR THREAD SPLICING DEVICE

The invention relates to a compressed-air thread splicing device for producing a knotless thread connection by splicing, the device having a splicing channel for receiving therein threads to be spliced to one another, the splicing channel being formed with at least one compressed-air injection opening and affording at least one of a plurality of operations to be performed on the fibers of the threads consisting of tangling, hooking, whirling and entwining the thread fibers mutually.

In such thread splicing devices, it is quite problematical to realize a splice connection of relatively good quality. If one wishes to fulfill the demand for a splice connection which is lasting, quite long thread ends standing away from the splice location are formed after the splicing operation. If one wishes to avoid such disturbing thread ends, the danger arises that the splice connection will not materialize because, due to the compressed-air blast or jolt of the splicing air, one of the two thread ends or both of the thread ends are blown out of the splicing channel.

It is accordingly an object of the invention to provide a compressed or pressurized-air thread splicing device which is lasting and has an aesthetically pleasant appearance and with which, especially, the number of faulty splices are minimized.

With the foregoing and other objects in view, there is provided, in accordance with the invention, a compressed-air thread splicing device for producing a knotless thread connection by splicing, the device having a splicing channel for receiving therein threads to be spliced to one another, the splicing channel being formed with at least one compressed-air injection opening and affording at least one of a plurality of operations to be performed on the fibers of the threads consisting of tangling, hooking, whirling and entwining the thread fibers mutually, comprising controllable means for holding at least end fibers of ends of the threads in friction contact with a thread guiding contour edge during the splicing operation. These means firmly hold the thread end directly at the end of the splicing channel so that it can not be blown away by the splicing air. On the other hand, also no ends which are too long can remain behind after production of the splice connection. Virtually no thread ends are visible any longer and, therefore, a severing device or a severing process for severing thread ends otherwise standing away from the completed splice connection becomes superfluous.

In accordance with another feature of the invention, the holding means comprise a controllable thread piecer forming a thread clamping line with the thread guiding contour edge.

In accordance with a further feature of the invention, the thread piecer is applicable by spring force against the thread guiding contour edge and the thread end crossing the clamping line, respectively.

In accordance with an added feature of the invention, the thread piecer is part of a controllable slider device.

In accordance with again another feature of the invention, the slider device is disposed laterally on a splicing head wherein the splicing channel is formed.

In accordance with an additional feature of the invention, at least one of the thread piecer and the slider device is formed with at least one recess for air escaping axially out of the splicing channel during the splicing operation.

In accordance with again another feature of the invention, at least one of the thread piecer and the slider device has a leadingly disposed thread separating pin.

In accordance with again a further feature of the invention the thread piecer comprises a bracket on a rear side thereof affording outflow of splicing air from the splicing channel.

In accordance with again an additional feature of the invention, the holding means comprise a thread entrainer spaced substantially the thickness of a thread from the thread guiding contour edge and movable transversely in front of an end opening of the splicing channel.

In accordance with still an added feature of the invention, the thread entrainer is part of a controllable slider device.

In accordance with still a further feature of the invention, the slider device is disposed laterally on a splicing head wherein the splicing channel is formed.

In accordance with a concomittant feature of the invention, at least one of the thread entrainer and the slider device is formed with at least one recess affording passage therethrough of air escaping axially out of the splicing channel.

By means of the thread piecers or feeders, the thread ends can, for example, be held springily or yieldingly in friction contact with the thread guiding contour edge. The latter per se can be formed, for example, out of the rounded and smoothed end part of the splicing channel or out of a special part disposed at the end of the splicing channel. Conventional thread guiding contours are already known to cover in part the axial end of the splicing channel.

When holding the thread ends, care must be taken, that the air can escape in axial direction out of the splicing channel during the splicing operation. For this purpose, various measures are provided in accordance with the invention. Moreover, measures may be provided which award any necessity for the other thread also to be held fast, although this, in turn, is allowable for tear-resistant threads and only a slight holding force measured thereat.

In particular cases, it may be better to provide a thread entrainer which is movable to behind the thread guiding contour edge and, accordingly, forms no clamping line with the thread guiding contour edge. In this case, the braking forces due to entanglement are quite sufficient to hold the thread ends. In any event, somewhat longer thread ends are produced which, however, depending upon the type of thread splicing device and the intensity of the splicing operation, if the splice connection is already durable but not yet entirely completed, especially at the instant wherein a thread twist is introduced into the splice operation, are again withdrawn in direction towards the splicing channel and wound around the thread, so that also then no ends standing away are present any longer.

By means of controllable slider devices, the thread feeder or piecer and the thread entrainer, respectively, are comfortably or conveniently controllable.

Other features which are considered as characteristic for the invention are set forth in the appended claims.

Although the invention is illustrated and described herein as embodied in a compressed-air thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 4 is a view like that of FIG. 1 of a third embodiment of the thread splicing device; and FIG. 5 is a fragmentary top plan view of FIG. 4.

Figure 1:
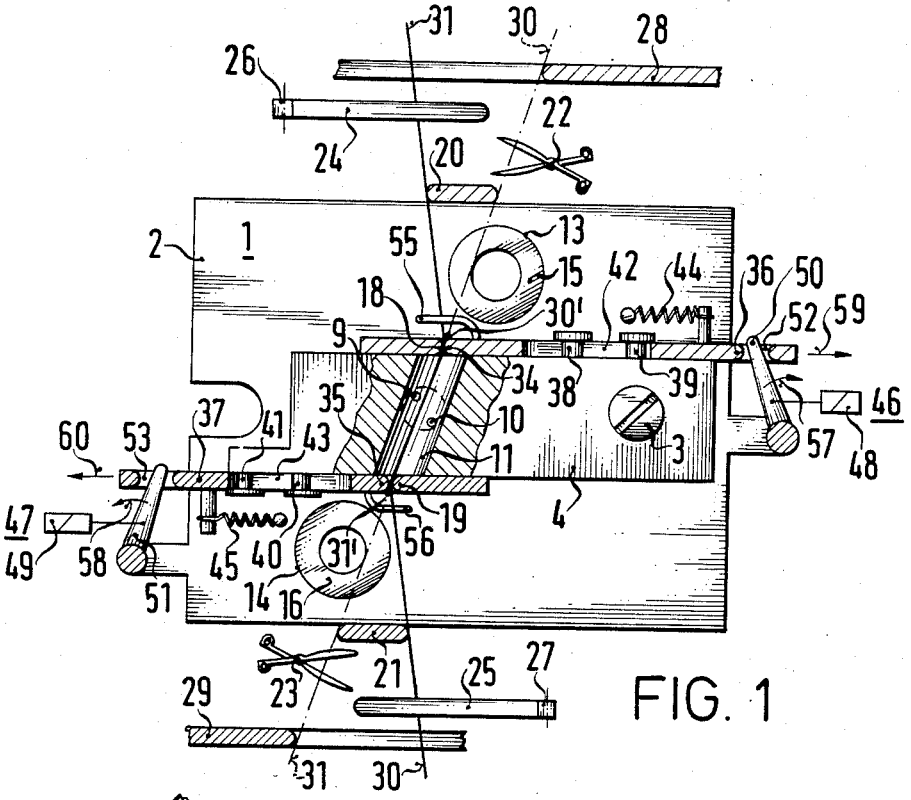
FIG. 1 is a diagrammatic front elevational view of a thread splicing device according to the invention.
Figure 2:
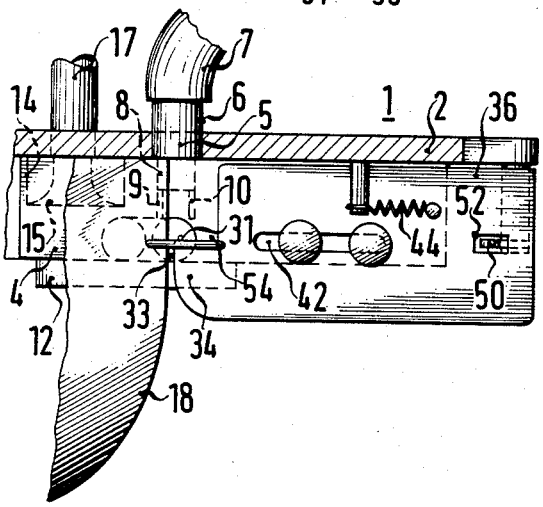
FIG. 2 is a fragmentary top plan view of FIG. 1.

Referring now to the drawing and first, particularly, to FIGS. 1 and 2 thereof, there are shown these parts of a first embodiment of the thread splicing device which are essential for understanding the invention. The compressed or pressurized-air thread splicing device 1 has a base plate 2 to which a splicing head 4 is fastened by a setscrew 3. A passageway or breakthrough 5 formed in the base plate 2 receives a nipple or connecting sleeve 6 to which a compressed-air base 7 is connected which leads to a controllable, otherwise non-illustrated compressed or pressurized air source. A connection is provided from the nipple 6 to a bore 8 of the splicing head 4. Two compressed-air injection openings 9 and 10 extend from the base 8 into a splicing channel 11 which is closable by a cover 12. Two additional bores formed in the base plate 2 serve for receiving therein a pair of pneumatic holding devices 13 and 14. Funnel-type inlet openings 15 and 16 of the holding devices lie above the base plate. Tubular projections are disposed underneath the base plate 2. The tubular projection 17 of the pneumatic holding device 14 is visible in FIG. 2. The tubular projections are connected to an otherwise non-illustrated controllable vacuum or underpressure source.

As shown in FIG. 1, a thread guiding contour edge 18 is provided at the upper end of the splicing channel 11, and a thread guiding contour edge 19 at the lower end of the splicing channel 11. As shown in FIG. 2, the upper axial outlet opening of the splicing channel 11 is about one-third covered by the thread guiding contour edge 18. The case is the same for the thread guiding contour edge 19 which likewise covers about one third of the lower end of the splicing channel 11. The thread guiding contours are formed by special attachments fastened to the splicing head 4. The base plate 2 carries a thread guiding plate 20 at the top thereof, and a thread guiding plate 21 at the bottom thereof. Near a thread severing device 22 is a thread loop puller 24 which is pivotable about a pivot axis 26. Near a thread severing device 23 is a similar thread loop puller 25 which is pivotable about a pivot axis 27. Another thread guiding plate 28 is disposed above the thread severing device 22, and a thread guiding plate 29 below the thread severing device 23.

The location of threads 30 and 31 which are to be spliced to one another is apparent from FIG. 1. The thread 30 comes from the right-hand side below, changes direction at the thread guiding contour edge 19, runs through the splicing channel 11, crosses over the pneumatic holding device 13, runs through the thread severing device 22 and engages the thread guiding plate 28. The thread 31 from the left-hand side above, changes direction at the thread guiding contour edge 18, runs through the splicing channel 11, crosses over the pneumatic holding device 14, passes through the thread severing device 23 and engages the thread guiding plate 29.

This is the position of the threads after they have been introduced into the splicing channel 11 but before they have been severed by the thread severing devices 22 and 23.

Both thread severing devices 22 and 23 are actuated after the cover 12 is closed. A thread end is formed, in this regard, on each thread 30, 31, while the severed thread lengths are removed by non-illustrated conventional means. For the purpose of holding the thread ends by friction contact at the thread guiding contour edges, the thread splicing device 1 has special controllable means which are described hereinafter in greater detail.

One of these controllable holding means is formed of a controllable thread feeder or thread piecer 34 which, together with the thread guiding contour edge 18, forms a thread clamping line 33. Another of these means is formed of a similarly constructed, controllable thread feeder or thread piecer 35 which, together with the other thread guiding contour edge 19, forms another thread clamping line. Both thread feeders 34 and 35 are applicable by spring force to the thread guiding contour edge and the thread end crossing the clamping line, respectively. It is clear from FIG. 1 that the thread feeder or thread piecer 34 is applied to the thread end 30′ of the thread 30, and the thread feeder or thread piecer 35 to the thread end 31′ of the thread 31.

Immediately after the severing operation, the two thread ends are longer than as shown in FIG. 1. By swinging both thread loop pullers 24 and 25 downwardly, thread loops are formed, however, whereby the thread ends become shorter accordingly. FIG. 1 shows both thread loop pullers 24 and 25 in inwardly swung condition. During the introduction of insertion of the threads, the thread loop pullers 24 and 25 had stood up vertically, as indicated by small circles in FIG. 1.

The thread feeder or thread piecer 34 is part of a controllable slider device 36, and the thread feeder or thread piecer 35 is part of a corresponding slider device 37. FIG. 2 shows the slider device 36 in engagement with the side wall of the splicing head 4. Two bolts 38 and 39, which are connected with the splicing head 4, serve for this purpose and, together with a coulisse or slot 42 of the slider device 36, form a rectilinear guide. A similar rectilinear guide is also provided by the slider device 37 wherein a coulisse or slotted link 43 is guided by bolts 40 and 41.

The slider device 36 also has a tension spring 44 with the aid of which the thread feeder or thread piecer 34 is applied springily against the thread end 30′. In a similar manner, a tension spring 45 belongs to the slider device 37, and with the aid thereof, the thread feeder or thread piecer 35 is springily applied to the thread end 31, as shown in FIG. 1.

The slider device 46, and the slider device 37 with an actuating device 47. The actuating device 46 is formed of a lever 50 actuable by an electromagnetic drive 48, the lever 50 being inserted into a slot 52 formed in the slider device 36. The other actuating device 47 is formed of a lever 51 actuable by an electromagnetic drive 49, the lever 51 being inserted into a slot 53 formed in the slider device 37.

It is apparent from FIG. 2 that the thread feeder or thread piecer 34 and the slider device 36, respectively, are formed with a recess 54 for the air axially escaping from the splicing channel 11 during the splicing operation. The recess 54 is of such dimensions that more than ¼ of the outlet cross section remains free. The other thread feeder or thread piecer 35 and the other slider device 37, respectively, are also constructed correspondingly.

In order that the thread end and not the other thread be held fast, the thread feeder or thread piecer 34 has a leadingly disposed thread separating pin 55. The thread feeder or thread piecer 35 also has a similar separating pin 56 for the same purpose. FIG. 1 clearly shows that the two separating pins lie over both threads 30 and 31, respectively, passing through the splicing device, and hold the threads down so that they cannot reach the clamping line.

To terminate the clamping, both electromagnetic drives 48 and 49 are actuated whereby both levers 50 and 51 are swung in direction of the curved arrows 57 and 58, and accordingly entrain the respective slider device so that the slider device 36 is returned in direction of the arrow 59, and the slider device 37 in direction of the arrow 60.

After both threads 30 and 31 have been inserted into the splicing channel 11 and after the cover 12 has been closed, the slider devices 36 and 37, which has been withdrawn until there, can be freed. Before the thread feeders 34 and 35 come into the vicinity of the thread guide contour edges 18 and 19, the two thread separating pins 55 and 56 dip between the threads and hold them separated from one another. Thereafter, the threads are severed by actuating the thread severing devices 22 and 23, and then both pneumatic holding devices 13 and 14 are subjected to vacuum or underpressure, so that the newly formed thread ends 30′ and 31′ are sucked in by the pneumatic holding devices and are made ready for splicing by the flowing air. Only then are both thread loop pullers 24 and 25 actuated, whereby the thread ends are slidingly drawn back through the clamping lines until they have the minimal length indicated in FIG. 1. Thereafter, the splicing operation can be performed by feeding compressed air with the aid of the compressed-air hose 7, whereby the thread ends, if the occasion arises, may possibly slide out of the clamping line in order also to be fully tied into the splice connection. After the splice connection has been formed, the slider devices 36 and 37 are withdrawn and, at the latest, then the thread loop pullers 24 and 25 are also swung back into the vertical position, after the cover 12 has been opened, the thread can then snap or spring out of the slicing channel 11.

Figure 3:
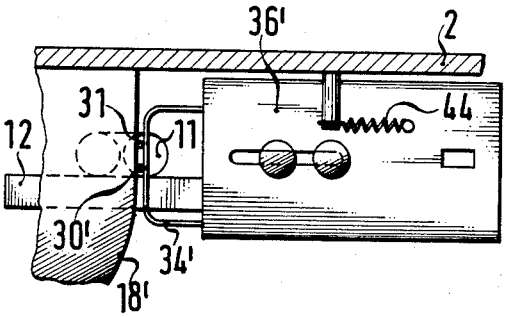
FIG. 3 is a view like that of FIG. 2 of another embodiment of the splicing device showing a different thread feeder or thread piecer thereof.

In the embodiment of FIG. 3, the thread feeder or thread piecer is formed of a yoke or bracket 34′ on the rear side thereof which permits the outflow of the splicing air from the splicing channel 11. In this embodiment of the invention, besides, the thread end 30′, the thread 31 extending through the splicer device is tightly held, which is permissible for specific threads such as threads having very great strength, for example.

In the embodiment of FIGS. 4 and 5, the compressed-air thread splicing device 61 has a base plate 62 to which a splicing head 64 is fastened by a setscrew 63. In contrast with the splicing head of the first embodiment described hereinabove, the splicing head 64 of FIGS. 4 and 5 has an angled-off shape for specific reasons. A passageway or break-through 65 in the base plate 62 receives therein a nipple or connecting nozzle 66 to which a compressed-air hose 67 is fastened. The nipple 66 is connected with a bore 68 formed in the splicing head 64, and from the bore 68, in turn, compressed-air injection openings 69 and 70 lead into the splicing channel 71. The latter is closable by a cover 72.

In an extension of the splicing channels 71, pneumatic holding devices 73 and 74, respectively, are located on the base plate 62. The funnel-type input openings 75 and 76 of the pneumatic holding devices 73 and 74 are located above the plate 62. Projections disposed below the base plate 62 extend from the pneumatic holding devices 73 and 74 to an unillustrated conventional controllable vacuum or underpressure source. In FIG. 5, a tubular projection 77 of the pneumatic holding device 74 is clearly shown.

According to FIG. 4, the upper outlet of the splicing channel 71 is covered partly by a thread guiding contour edge 78. Also, the lower outlet of the splicing channel 71 is covered by a thread guiding contour edge 79.

A thread guiding plate 20 is disposed on the top of and a thread guiding plate 21 at the bottom of the base plate 62. Above the thread guiding plate 20 is a thread severing device 22, and below the thread guiding plate 21 a thread severing device 23. Near the thread severing device 22 is a thread loop puller 24, and near the thread severing device 23 a thread loop puller 25. The thread loop puller 24 is mounted so as to be pivotable about the pivot axis 26. In a similar manner, the thread loop puller 25 is mounted so as to be pivotable about a pivot axis 27. Above the thread loop puller 24, there is located a further thread guiding plate 28, and below the thread loop puller 25, a thread guide plate 29.

In this embodiment of the invention, likewise controllable means are provided which hold the end fibers of the respective thread end, during the splicing operation, in friction contact with the thread guiding contour edges 78 and 79, respectively. One of these means is formed of a thread entrainer 82 spaced by somewhat one thread thickness from the thread guiding contour edge 78 and movable transversely to and in front of the upper end opening of the splicing channel 71 to behind the thread guiding contour edge 78. Another one of these means is formed of a thread entrainer 83 spaced by somewhat one thread thickness from the thread guiding contour edge 79 and movable transversely to and in front of the lower end opening of the splicing channel 71 to behind the thread guiding contour edge 79.

The thread entrainer 82 is part of a controllable slider device 84, and the thread entrainer 83 part of a controllable slider device 85. Both slider devices 84 and 85 are disposed laterally on the splicing head 64.

Rectilinear guidance of the slider device 84 is ensured by a coulisse or slotted link 86 in conjunction with two bolts 88 and 89 fastened to the splicing head 64. In a similar manner, rectilinear guidance of the slider device 85 is ensured by a coulisse or slotted link 87 in conjunction with two bolts 90 and 91 fastened to the splicing head 64.

FIG. 4 shows that the slider device 84 is drawn towards the left-hand side by a tension spring 92 until an end stop of the coulisse or slot 86 engages the bolt 89. In a similar manner, the slider device 85 is drawn towards the right-hand side by a tension spring 93 until an end stop of the coulisse 87 engages the bolt 91.

The slider device 84 is connected to an actuating device 46 which is formed of a lever 50 actuable by an electromagnetic drive 48 and engaging in a slot 52 formed in the slider device 84. Correspondingly, the slider device 85 is connected to an actuating device 47 formed of a lever 51 movable by an electromagnetic drive 49 and engaging in a slot 53 formed in the slider device 85.

The thread entrainer 82 has a recess or cutout 94 which permits passage therethrough of air escaping axially out of the splicing channel 71, as shown especially in FIG. 5. In a similar manner, the thread entrainer 83 also has a recess or cutout 95.

As shown in FIG. 4, both thread entrainers 82 and 83 are swung outwardly. They are under the effect of their tension springs 92 and 93, respectively. The thread 80 comes from below, is deflected at the thread entrainer 83 and at the thread guiding contour edge 79, runs through the splicing channel 71 and ends with its thread end 80' at the thread entrainer 82 which holds the thread end in frictional contact with the thread guiding contour edge 78. The other thread 81 comes from above, is deflected at the thread entrainer 82 and at the thread guiding contour edge 78 runs through the splicing channel 71 and ends with its thread end 81' at the thread entrainer 83 which holds the thread end 81' in frictional contact with the thread guiding contour edge 79. Both of the thread loop pullers 24 and 25 are already swung in. The earlier thread course existing before the formation of the thread ends is indicated in phantom.

The slider device of FIGS. 4 and 5 functions moreover in the exact manner as the slider device of the first embodiment of the invention. Also, the working steps or stages of the thread make-ready process and of the splicing process for the different embodiments are the same.

We claim:

1. Compressed-air thread splicing device for producing a knotless thread connection by splicing, the device having a splicing channel for receiving therein threads to be spliced to one another, the splicing channel being formed with at least one compressed-air injection opening and affording at least one of a plurality of operations to be performed on the fibers of the threads consisting of tangling, hooking, whirling and entwining the thread fibers mutually, comprising first means for forming a thread guide contour edge at one end of the splicing channel, and second means for forming a thread guide contour edge at the other end of the splicing channel, said thread guide contour edges partly covering a respective outlet and inlet of the splicing channel, and controllable means for holding at least end fibers of ends of the threads in friction contact with at least one of the thread guiding contour edges during the splicing operation.

2. Thread splicing device according to claim 1, wherein said holding means comprise a controllable thread piecer forming a thread clamping line with said thread guiding contour edge.

3. Thread splicing device according to claim 2, wherein said thread piecer is applicable by spring force against said thread guiding contour edge and the thread end crossing the clamping line, respectively.

4. Thread splicing device according to claim 2, wherein said thread piecer is part of a controllable slider device.

5. Thread splicing device according to claim 4, wherein said slider device is disposed laterally on a splicing head wherein the splicing channel is formed.

6. Thread splicing device according to claim 4, wherein at least one of said thread piecer and said slider device is formed with at least one recess for air escaping axially out of the splicing channel during the splicing operation.

7. Thread splicing device according to claim 4, wherein at least one of said thread piecer and said slider device has a leadingly disposed thread separating pin.

8. Thread splicing device according to claim 2, wherein said thread piecer comprises a bracket on a rear side thereof affording outflow of splicing air from the splicing channel.

9. Thread splicing device according to claim 1, wherein said holding means comprise a thread entrainer spaced substantially the thickness of a thread from said thread guiding contour edge and movable transversely in front of an end opening of the splicing channel.

10. Thread splicing device according to claim 9, wherein said thread entrainer is part of a controllable slider device.

11. Thread splicing device according to claim 10, wherein said slider device is disposed laterally on a splicing head wherein the splicing channel is formed.

12. Thread splicing device according to claim 10, wherein at least one of said thread entrainer and said slider device is formed with at least one recess affording passage therethrough of air escaping axially out of the splicing channel.

* * * * *